US005277422A

United States Patent [19]

Coe

[11] Patent Number: 5,277,422

[45] Date of Patent: Jan. 11, 1994

[54] GAMES RACKET FRAME

[75] Inventor: Andrew O. Coe, Pulborough, England

[73] Assignee: Dunlop Limited, London, United Kingdom

[21] Appl. No.: 949,782

[22] Filed: Sep. 22, 1992

[30] Foreign Application Priority Data

Sep. 27, 1991 [GB] United Kingdom ..... 9120585

[51] Int. Cl.[5] ..... A63B 49/02; A63B 51/08

[52] U.S. Cl. ..... 273/73 C

[58] Field of Search ..... 273/73 R, 73 C, 73 D, 73 E, 73 G, 73 H

[56] References Cited

U.S. PATENT DOCUMENTS

| | | | |
|---|---|---|---|
| 1,539,019 | 5/1925 | Nikonow | 273/73 R |
| 4,177,990 | 12/1979 | Kajiwara | 273/73 C |
| 4,280,699 | 7/1981 | Drake . | |
| 5,048,830 | 9/1991 | Lo | 273/73 C |
| 5,071,124 | 12/1991 | Davis | 273/73 C X |
| 5,076,583 | 12/1991 | Hsu | 273/73 C |
| 5,110,125 | 5/1992 | Blanc | 273/73 C |

FOREIGN PATENT DOCUMENTS

| | | | |
|---|---|---|---|
| 0023826 | 8/1935 | Australia | 273/73 C |
| 0176021 | 4/1986 | European Pat. Off. | 273/73 C |

OTHER PUBLICATIONS

*Taiwan Buyers' Guide*, Dec. 1987, p. 226.

"The New Design of Symmetry", Sep. 1991.

*Primary Examiner*—William Stoll

*Attorney, Agent, or Firm*—Lorusso & Loud

[57] ABSTRACT

A novel games racket frame, particularly a squash racket frame is asymmetric in that the cross-section of the head portion measured perpendicular to the plane in which the strings will lie varies. Preferably the frame is strung in a "double fan" pattern i.e. the longitudinal strings diverge from the head portion adjacent the shaft portion and the cross-strings diverge from one side to the other.

10 Claims, 3 Drawing Sheets

GAMES RACKET FRAME

BACKGROUND OF THE INVENTION

This invention relates to a novel games racket frame, and particularly to a squash racket frame.

SUMMARY OF THE INVENTION

According to the present invention a games racket frame comprises a head portion for stringing, a shaft portion, and a handle portion wherein the dimension of a cross-section taken through the head portion measured perpendicular to the plane in which the strings will lie is different on each side of a notional plane perpendicular to that in which the strings will lie and passing through the axis of the shaft portion, in that the dimension on a first side of said notional plane is smaller than that on the second side of such notional plane over a distance of 40% or less of the periphery of the head portion.

DESCRIPTION OF THE PREFERRED EMBODIMENT

Preferably 30% or less of the periphery of the head portion is smaller in cross-sectional dimension i.e. in the so-called "major axis" than the largest dimension in the major axis of the other side of the head portion. Preferably the size ratio of the largest dimension in the major axis to the smallest dimension in the major axis is at least 1.25:1, more preferably in the range 1.25:1 to 1.75:1, and even in the range 1.5:1 to 1.75:1. Thus in one side of the head portion the frame dimension in the major axis could be 15 to 20 mm and in the other side the frame dimension in the major axis could be 1.25 to 1.75 times that, bearing in mind that current International Squash Federation Rules specify a maximum major axis frame dimension of 26 mm. In a preferred embodiment, the smaller section extends substantially from the 6 o'clock position to the 2 o'clock position on the same side of the head portion. Although the racket of the present invention is asymmetrical as regards the side view (major axis) it is preferably symmetrical in the minor axis i.e. in plan view (e.g. see Figures I and IV plan view). The minor axis is the width of the head portion e.g. as indicated by dimension "5" of Figures II and III.

Preferably the dimension of the major axis in the head portion changes by tapering rather than in a stepped fashion.

The present invention is particularly advantageous when applied to a squash racket for the following reasons, based on the assumption that the racket is always held by the player with the widest head section side closest to the wall of the court for both forehand and backhand strokes.

Figure 5:
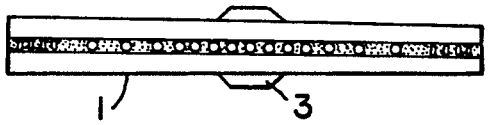
FIG. 5 is a top view of the first embodiment.
Figure 3:
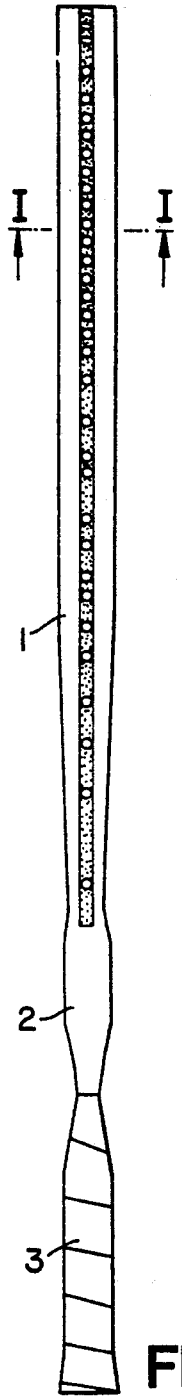
FIG. 3 shows a left side view of the first embodiment.
Figure 1:
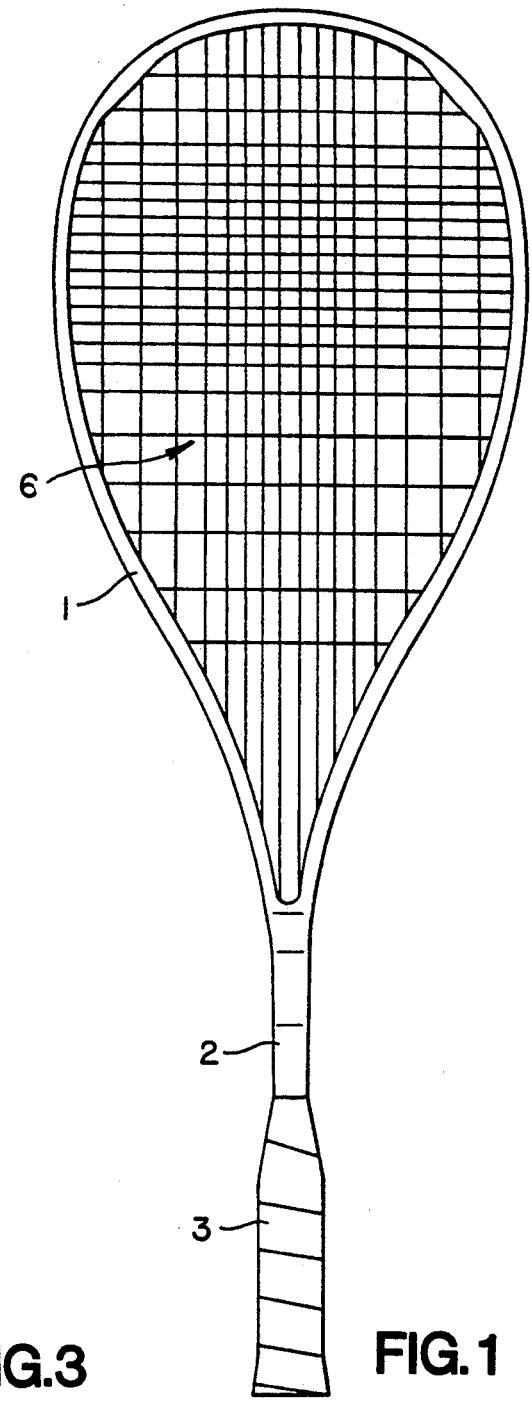
FIG. 1 shows a front view of a first embodiment of the claimed invention.
Figure 2:
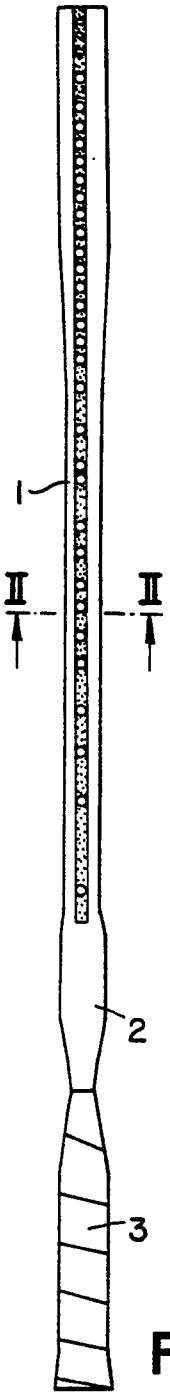
FIG. 2 shows a right side view of the first embodiment.
Figure 4:
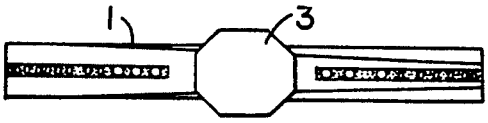
FIG. 4 shows a bottom view of the first embodiment.
Figure 6:
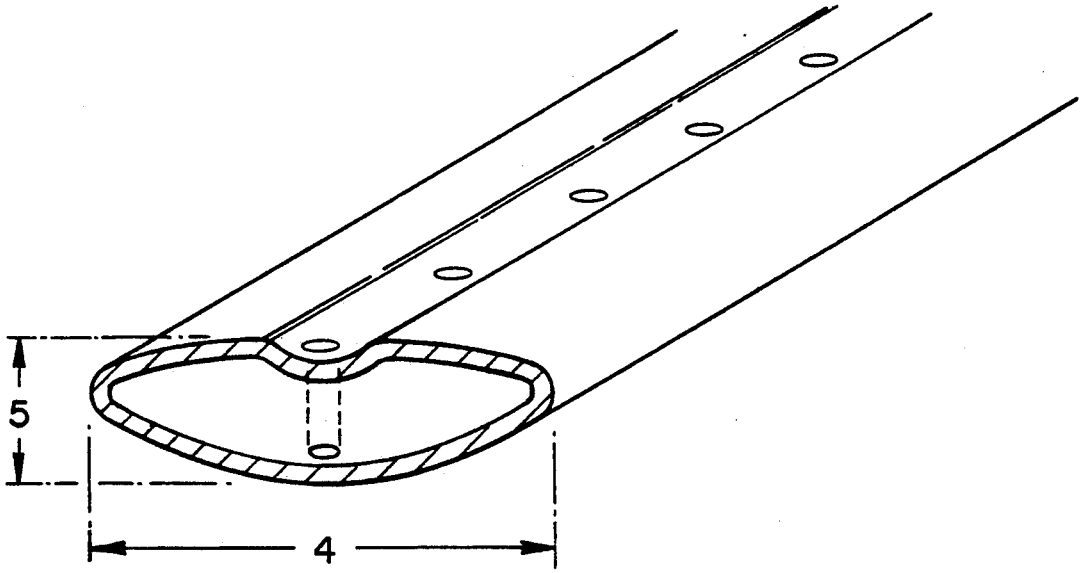
FIG. 6 shows a sectional view along line A—A of FIG. 3.
Figure 7:
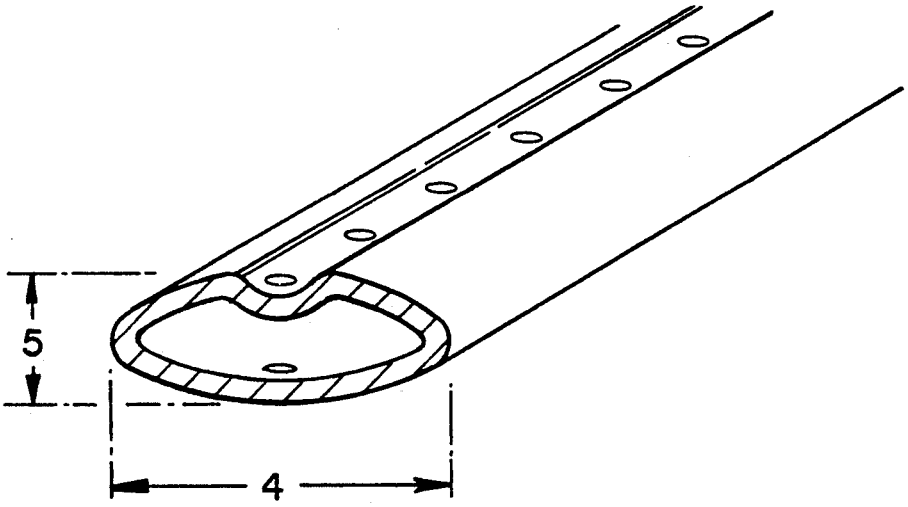
FIG. 7 shows a sectional view along line B—B of FIG. 2.
Figure 12:
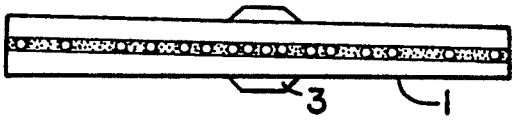
FIG. 12 is a top view of the second embodiment.
Figure 10:
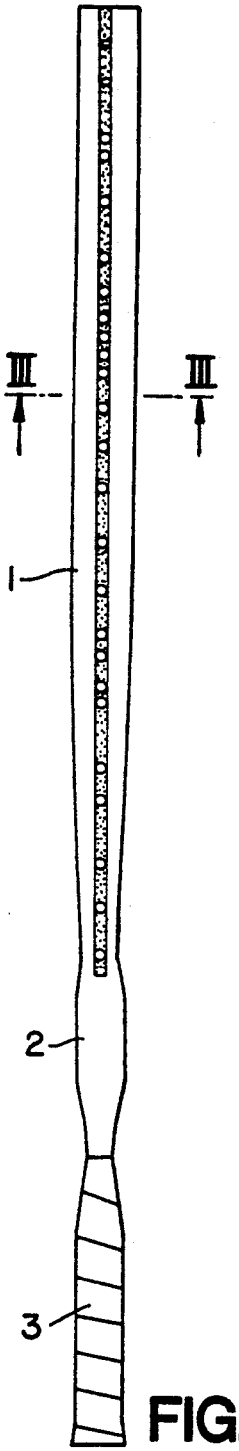
FIG. 10 is a left side view of the second embodiment.
Figure 8:
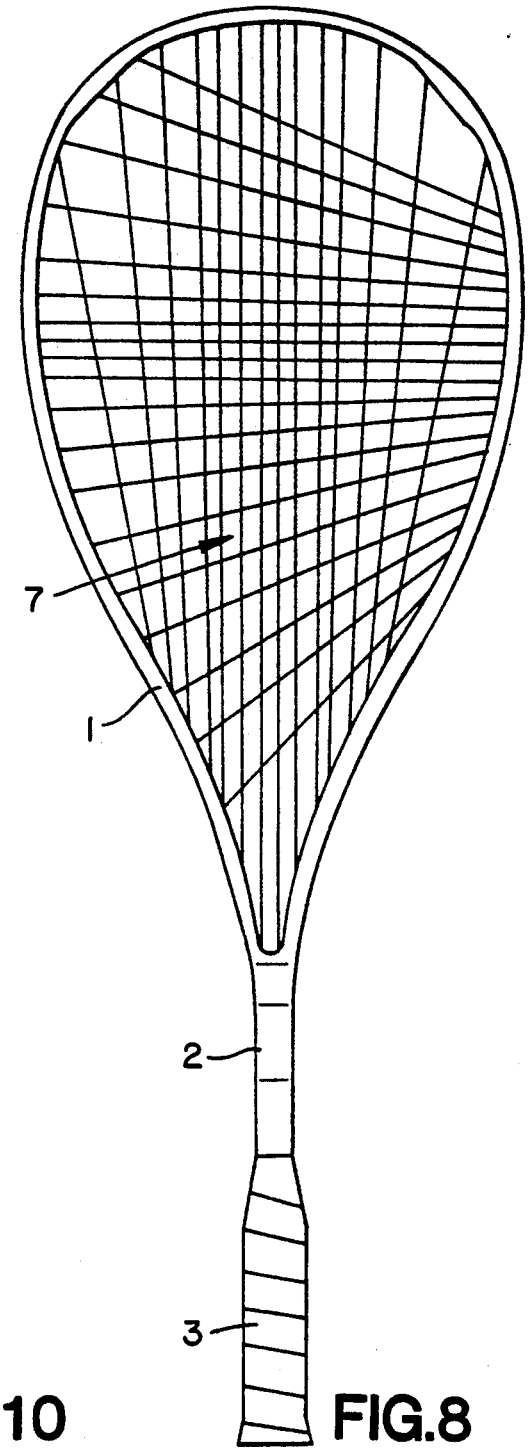
FIG. 8 is a front view of a second embodiment of the claimed invention.
Figure 9:
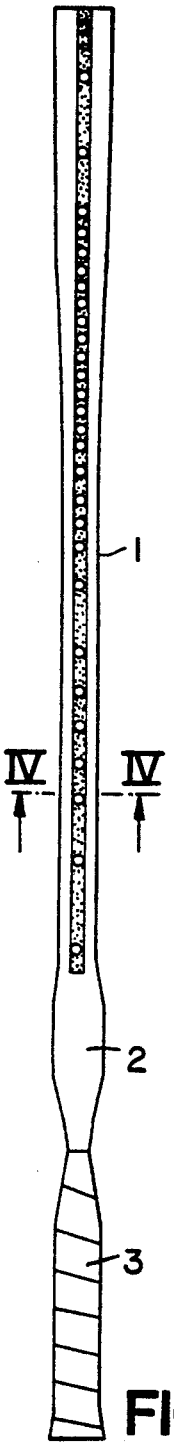
FIG. 9 is a right side view of the second embodiment.
Figure 11:
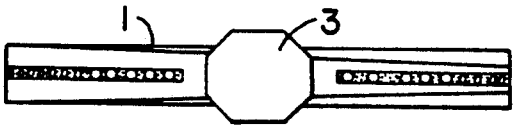
FIG. 11 is a bottom view of the second embodiment.

Figures I, II, and III show in one embodiment of the present invention the asymmetric nature of the frame sections across the head portion 1 of the racket joined by a shaft portion 2 to a handle portion 3, Figure II being a section along the major axis line A—A of one side view of the head portion 1 of Figure I and Figure III being a section along the major axis line B—B of the other side view of the head portion 1 of FIG. 1. The one side of the head features a section A—A which is very slim through the minor axis 5 i.e. in the plane of the strings providing improved aerodynamic properties, and relatively large through the major axis 4—see Figure II (here shown to be 26 mm—the maximum dimension allowed by the current ISRF rules). This large major axis dimension 4 provides a frame section which is very stiff and which will therefore provide the player with significantly more power when striking a ball which is close to the wall due to the following:

1. The very slim minor axis dimension will enable the player to hit a ball which is close to the wall of the court with less tendency for the ball to contact the frame.
2. On striking the close-to-the-wall ball then the relatively stiff section of this side of the racket will not suffer the same level of energy loss due to deformation which would be experienced on conventional rackets. The asymmetric design and higher stiffness of this side of the frame which extends down towards the opening of the twin shafts i.e. the racket throat also provides increased resistance to deformation of the head as a result of torsional strain caused by off-centre hits. This will have the dual advantage of allowing the player to control the ball better in off-centre hits and also reducing the frequency of vibrations caused by torsional deformation to a level where they are not so easily felt by the player as in a conventional racket.

The asymmetric design of this racket allows for the optimum stiffness to be obtained when the racket face strikes the ball close to the wall.

A particularly preferred embodiment of the present invention is shown in Figure IV which incorporates a "double fan" string pattern 7.

The main strings (longitudinal) are more concentrated (dense) in the lower portion of the head than in the top of the head with each string from the middle outwards being of a gradually greater angle to the axis parallel to the centre main string.

In addition the cross-strings are similarly arranged so that the strings are more densely concentrated on the side of the head which features a conventional dimension D—D i.e. the side which will not come into contact with the wall. Consequently the cross-string holes on the wider profile side C—C of the head are more widely spread than in a conventionally strung racket.

The relatively wider spacing of the string holes on the side of the racket head C—C which will suffer impacts with the wall or court floor is designed to improve durability as this feature will reduce the likelihood of fractures occurring in the composite material between string holes. This is well known to be a major cause of failure in composite squash rackets.

This frame design should therefore also provide a product with considerably better impact strength than conventional rackets.

Another benefit of this "Double Fan" string pattern 7 is that the relatively wider spaced areas of the string bed which due to the double fan design occur around the top of the head and more importantly on the side of the racket C—C which comes into close contact with the court wall, provides increased power for the player due to the increased deformation allowed by the greater spacing of individual cross-and main-strings. It has long been established that increased elasticity of strings gives the player more power as this leads to less compression and energy loss of the ball during impact with the strings.

The DOUBLE FAN string system 7 has an additional beneficial feature which results from the increased uniformity in length of both the main-and cross-strings. In conventional orthogonal patterns the central main-and cross-strings are those which are of greatest length with outer strings gradually becoming shorter.

As discussed, a longer string length is desirable as this provides increased power due to increased elasticity, however the Double Fan string pattern has the added benefit of providing as far as possible within the constraints of the shown head shape, both cross-and main-strings of equidistant length, thereby promoting much more consistent response across all areas of the racket face than in conventional rackets.

This novel design will conceivably allow greater cross-and main-string length, and hence greater power, than in conventional rackets.

It should be noted that the main aim of the Double Fan string system is to create a pattern where the strings are more widely spaced (and hence providing more power) in the areas of the string face close to the frame edge on the racket which is designed to come into close contact with the wall. In this way the power zone can be moved off-centre relative to normal symmetrical rackets.

The benefits of this design are as follows:

When a player attempts to hit a ball which is close to the wall of the court the Double Fan string pattern will greatly improve the possibility that the ball will reach the front wall of the court as the increased power resulting from off-centre hits on the racket face closest to the wall will compensate for any delay in timing of the shot as a result of;

a) a glancing collision with the wall, or b) the player's natural instinct not to want to strike the wall with his racket.

Sections along line C—C and D—D of Figure IV correspond to Figures II and III respectively.

In order to achieve a product with optimum playability and durability as described, it may be necessary to consider the geometry of the frame section required to support such a pattern.

Due to the relative concentration of string holes on the side of the racket head which is not likely to impact the court wall, it is necessary to have increased frame wall thickness dimensions i.e. 1 mm or above, as compared to that in the wider profile sections in order to prevent crack formation etc occurring between string holes due to impact with walls or stress created during normal play.

On the opposite side of the racket i.e. the side most likely to impact with the wall—the string holes are on average positioned significantly further apart and the section is inherently stronger both in terms of torsional and impact strength than the opposite side. This, combined with the increased stiffness of the section as described, has been shown to provide increased impact strength due to the increased resistance of the section to deform during impact and hence reducing the possibility of fibres reaching their yield point.

What I claim is:

1. A games racket frame comprises a head portion for stringing, a shaft portion, and a handle portion wherein the dimension of the cross-section taken through the head portion measured perpendicular to the plane in which the strings will lie is different on a first side and a second side of a notional plane perpendicular to that in which the strings will lie and passing through the axis of the shaft portion, in that on a first side of said notional plane a piece of the head portion adjacent the handle portion is smaller in cross-sectional dimension than a piece of the head portion remote from the handle portion on said first side of said notional plane and said piece of the head portion which is smaller in cross-sectional dimension has a length of 40% or less than a total length of the first and second sides combined of the head portion, and is smaller in cross-sectional dimension than substantially any cross-sectional dimension of said head portion on said second side.

2. A games racket frame according to claim 1 wherein 30% or less of the periphery of the head portion has a smaller dimension on the first side of said notional plane.

3. A games racket frame according to claim 1 wherein the ratio of the largest dimension on the second side of the notional plane to the smallest dimension on the first side of the notional plane is at least 1.25:1.

4. A games racket frame according to claim 1 wherein the ratio is in the range 1.25:1 to 1.75:1.

5. A games racket frame according to claim 1 wherein the ratio is in the range of 1.5:1 to 1.75:1.

6. A games racket frame according to claim 1 wherein the smallest dimension of the cross-section taken through the head portion measured perpendicular to that in which the strings will lie is in the range 15 to 20 mm.

7. A games racket frame according to claim 1 wherein said piece of said head portion of said first side adjacent the handle portion extends substantially from the 6 o'clock position around the head portion to the 2 o'clock position on the same side of the head portion.

8. A games racket frame according to claim 1 wherein the dimension of the head portion in the plane in which the strings will lie is substantially constant throughout.

9. A games racket frame according to claim 1 wherein the dimension of the cross-section of the head portion measured perpendicular to the plane in which the strings will lie changes by tapering.

10. A games racket comprising a games racket frame according to claim 1 which is strung so that the longitudinal strings diverge from the head portion adjacent the shaft portion and the cross-strings diverge from the side of the head portion which contains the smaller dimension in cross-section measured perpendicular to the plane in which the strings lie.

* * * * *